US011020966B2

(12) United States Patent
Ishida et al.

(10) Patent No.: US 11,020,966 B2
(45) Date of Patent: Jun. 1, 2021

(54) LIQUID EJECTION HEAD SUBSTRATE, METHOD OF MANUFACTURING LIQUID EJECTION HEAD SUBSTRATE, AND LIQUID EJECTION HEAD

(71) Applicant: CANON KABUSHIKI KAISHA, Tokyo (JP)

(72) Inventors: Yuzuru Ishida, Yokohama (JP); Maki Kato, Fuchu (JP); Yoshinori Misumi, Tokyo (JP); Tsubasa Funabashi, Yokohama (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/383,449

(22) Filed: Apr. 12, 2019

(65) Prior Publication Data

US 2019/0329549 A1 Oct. 31, 2019

(30) Foreign Application Priority Data

Apr. 27, 2018 (JP) ..... JP2018-087531
Mar. 8, 2019 (JP) ..... JP2019-042261

(51) Int. Cl.
*B41J 2/14* (2006.01)
*B41J 2/16* (2006.01)

(52) U.S. Cl.
CPC ..... *B41J 2/14072* (2013.01); *B41J 2/14129* (2013.01); *B41J 2/1629* (2013.01); *B41J 2/1646* (2013.01); *B41J 2202/18* (2013.01)

(58) Field of Classification Search
CPC ..... B41J 2/14072; B41J 2/14129; B41J 2202/18; B41J 2/14016; B41J 2/164;
(Continued)

(56) References Cited

U.S. PATENT DOCUMENTS 10,632,748 B2 * 4/2020 Kato ..... B41J 2/14129
10,730,294 B2 * 8/2020 Funabashi ..... B41J 2/1642
(Continued)

FOREIGN PATENT DOCUMENTS

CN 1704243 A 12/2005
CN 104002558 A 8/2014
(Continued)

*Primary Examiner* — Geoffrey S Mruk
(74) *Attorney, Agent, or Firm* — Canon U.S.A., Inc. IP Division

(57) ABSTRACT

A liquid ejection head substrate including a base including a surface having a first and second heat generation elements, a conductive first covering portion, a conductive second covering portion, an insulating layer disposed between the first heat generation element and the first covering portion, and between the second heat generation element and the second covering portion, a fuse portion, first wiring electrically connected to the first covering portion through the fuse portion, the first wiring electrically connecting the first covering portion to the second covering portion, a terminal electrically connected to the first covering portion and the second covering portion through the first wiring, second wiring, and electric connection portions provided between the fuse portion and the terminal in a current path passing through the first wiring, the electric connection portions parallelly connecting the first and second wiring to each other.

21 Claims, 9 Drawing Sheets

(58) Field of Classification Search
CPC ..... B41J 2/1629; B41J 2/1603; B41J 2/1642; B41J 2/05
See application file for complete search history.

(56) References Cited

U.S. PATENT DOCUMENTS

| | | | |
|---|---|---|---|
| 2010/0149230 | A1 | 6/2010 | Silverbrook et al. |
| 2014/0300667 | A1 | 10/2014 | Takahashi et al. |

FOREIGN PATENT DOCUMENTS

| | | | |
|---|---|---|---|
| CN | 105142916 | A | 12/2015 |
| CN | 106457861 | A | 2/2017 |
| CN | 106486223 | A | 3/2017 |
| CN | 107073956 | A | 8/2017 |
| CN | 107799153 | A | 3/2018 |
| JP | 2014124923 | A | 7/2014 |

* cited by examiner

FIG. 7A1
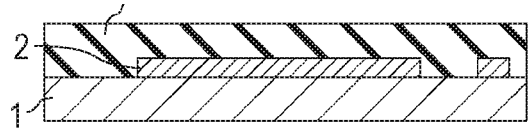
FIG. 7A2
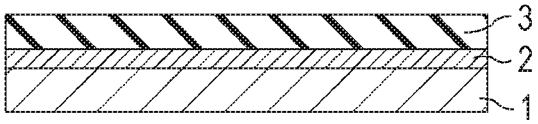
FIG. 7B1
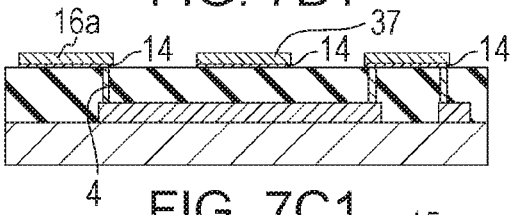
FIG. 7B2
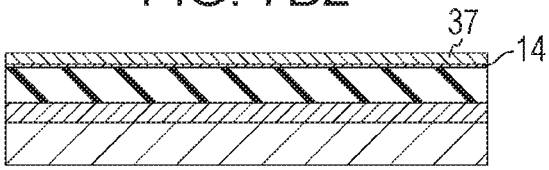
FIG. 7C1
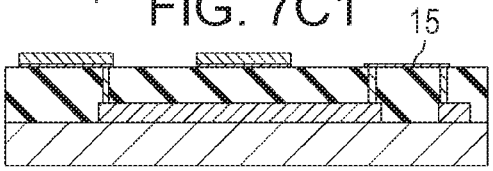
FIG. 7C2
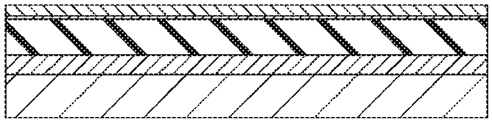
FIG. 7D1
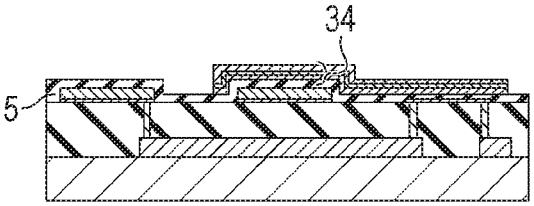
FIG. 7D2
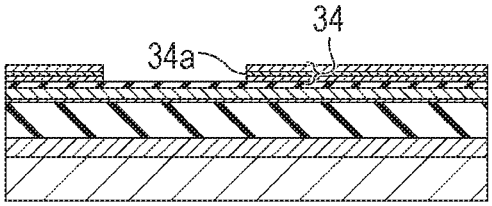
FIG. 7E1
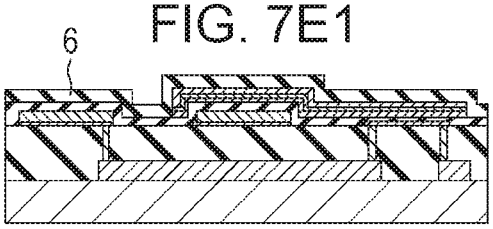
FIG. 7E2
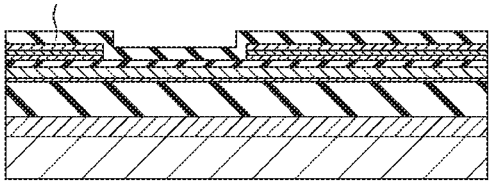
FIG. 7F1
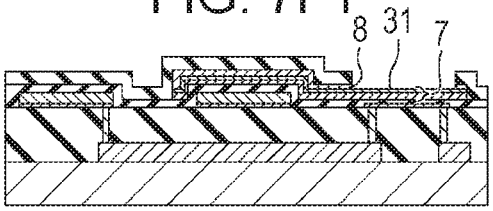
FIG. 7F2
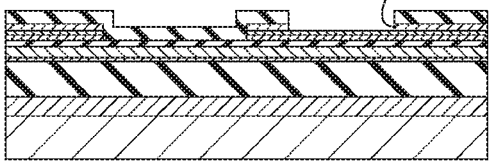
FIG. 7G1
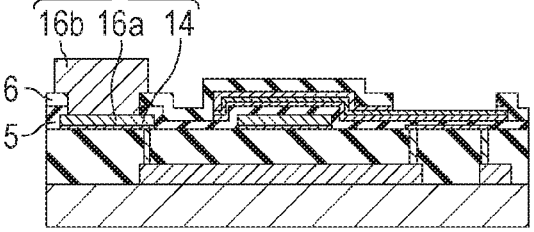
FIG. 7G2
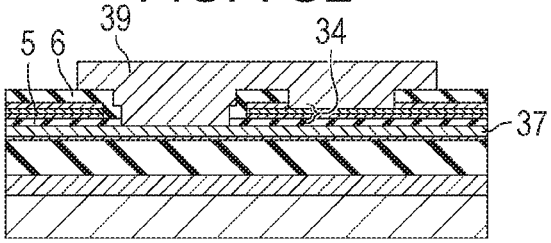

LIQUID EJECTION HEAD SUBSTRATE, METHOD OF MANUFACTURING LIQUID EJECTION HEAD SUBSTRATE, AND LIQUID EJECTION HEAD

BACKGROUND OF THE DISCLOSURE

Field of the Disclosure

The present disclosure relates to a liquid ejection head substrate, a method of manufacturing a liquid ejection head substrate, and a liquid ejection head.

Description of the Related Art

At present, many liquid ejection apparatuses are employed in which a liquid ejection head is mounted. The liquid ejection head ejects a droplet from an ejection opening using bubble generating energy created by film boiling a liquid by applying electricity to a heat generation element and heating the liquid inside a liquid chamber. When printing is performed in such a liquid ejection apparatus, there are cases in which a physical effect, such as an impact caused by cavitation that occurs when liquid bubbling, shrinkage, and debubbling take place in an area on a heat generation element, is exerted in the area on the heat generation element. Furthermore, when the liquid is ejected, since the heat generation element becomes high in temperature, there are cases in which a chemical action, such as a component of the liquid becoming decomposed by heat, becoming attached to a surface of the heat generation element, and solidifying and accumulating on the surface of the heat generation element, occur in a region of the heat generation element. In order to protect the heat generation element from such a physical effect or a chemical action, a protective layer serving as a covering portion that covers the heat generation element is disposed on the heat generation element.

The protective layer is typically formed of a metal material such as tantalum or iridium, and is disposed at a position where the protective layer comes in contact with the liquid. Furthermore, in order to achieve insulation between the heat generation element and the protective layer, an insulating layer is disposed between the heat generation element and the protective layer.

However, there is a possibility of the function of the insulative layer becoming lost (a chance failure) due to some kind of cause and a connection may be established in which electricity directly flows from the heat generation element or the wiring to the protective layer. When a portion of the electricity supplied to the heat generation element flows to the protective layer, an electrochemical reaction may occur between the protective layer and the liquid and the protective layer may become degenerated or eluted, and the durability of the protective layer may be degraded. Furthermore, in a case in which a plurality of protective layers are electrically connected to each other, the current may flow to a protective layer other than the protective layer in which connection with the heat generation element has been established, and the effect of the degeneration may spread inside the liquid ejection head.

Note that Japanese Patent Laid-Open No. 2014-124923 describes a configuration in which a plurality of protective layers are each connected through fuse portions to common wiring that are electrically coupled to the protective layers. In such a configuration, when a current flows into one of the protective layers due to an establishment of a connection described above, the current causes the corresponding fuse portion to be cut; accordingly, electric connection with other protective layers becomes disconnected as well. With the above, the effect of the degeneration of the protective layer can be suppressed from spreading inside the liquid ejection head.

SUMMARY OF THE DISCLOSURE

A liquid ejection head substrate according to an aspect of the present disclosure includes a base including a surface in which a first heat generation element and a second heat generation element that generate heat to eject liquid are provided, a conductive first covering portion that covers the first heat generation element, a conductive second covering portion that covers the second heat generation element, an insulating layer disposed between the first heat generation element and the first covering portion, and between the second heat generation element and the second covering portion, a fuse portion, first wiring electrically connected to the first covering portion through the fuse portion, the first wiring electrically connecting the first covering portion and the second covering portion to each other, a terminal electrically connected to the first covering portion and the second covering portion through the first wiring, second wiring provided at a position different from that of the first wiring in an orthogonal direction with respect to the surface of the base, and a plurality of electric connection portions provided between the fuse portion and the terminal in a path of current passing through the first wiring, the plurality of electric connection portions connecting the first wiring and the second wiring to each other in parallel.

Further features and aspects of the disclosure will become apparent from the following description of example embodiments with reference to the attached drawings.

BRIEF DESCRIPTION OF THE DRAWINGS

FIGS. 7A1 to 7G2 are partial cross-sectional views illustrating manufacturing steps of the liquid ejection head substrate.

DESCRIPTION OF THE EMBODIMENTS

Figure 1:
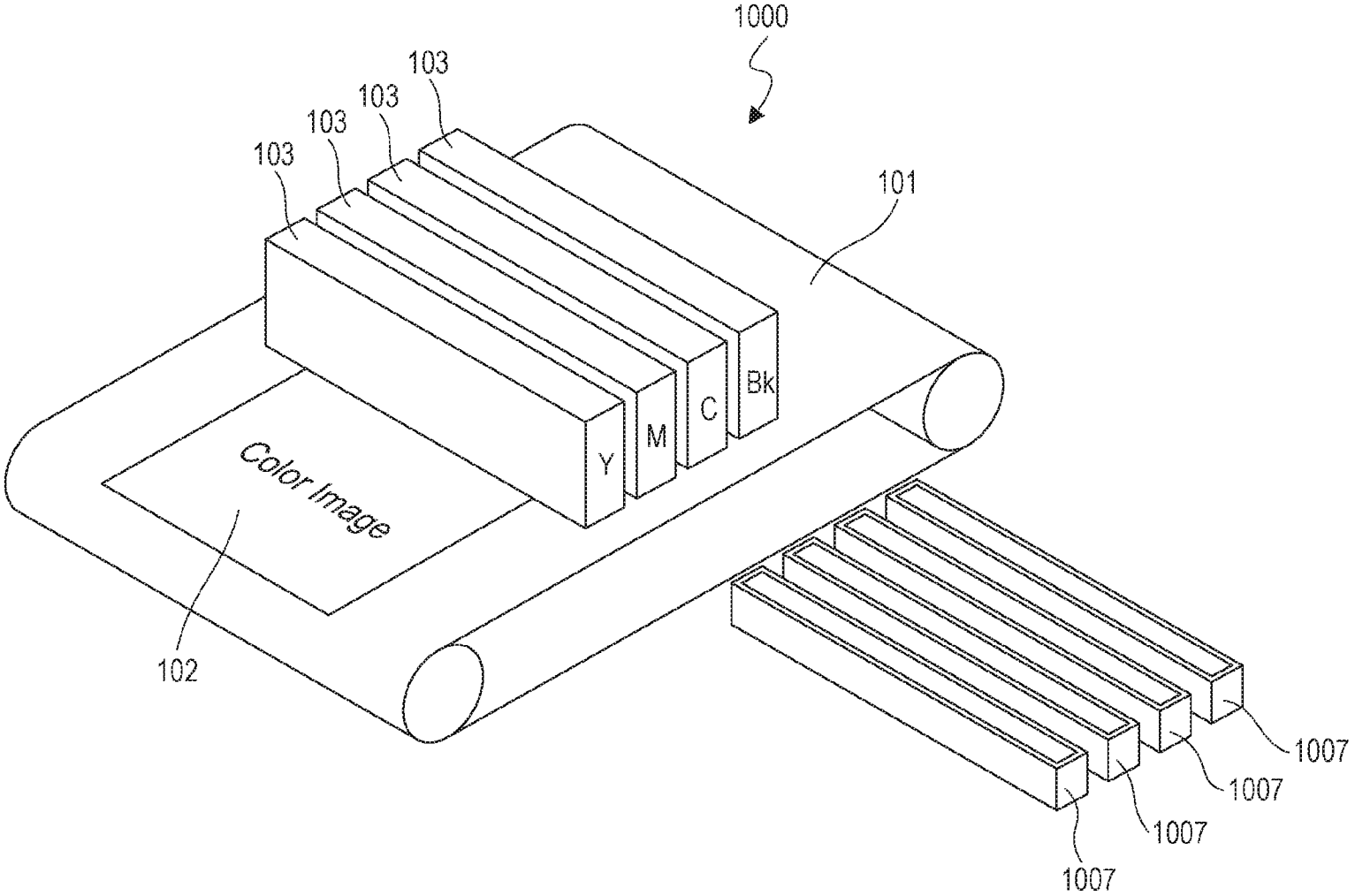
FIG. 1 is a schematic block diagram of an example printing apparatus.

If wiring resistance of a piece of common wiring to a fuse portion is high, a value of current flowing through the fuse portion will become small, and it will be difficult to allow the current necessary to disconnect the fuse portion to flow. The above may impair the function of the fuse portion. Particularly, if the length of the liquid ejection head substrate is long and the common wiring extends in a length direction of the substrate, the wiring resistance of the common wiring will tend to become higher. Furthermore, if a width of the liquid ejection head substrate is small, a width of the common wiring will be small as well; accordingly, the resistance of the wiring will tend to be high. Accordingly, depending on the position where the fuse portion is provided, the current value flowing through the fuse portion becomes smaller and the possibility of the fuse portion not becoming disconnected increases.

Accordingly, the present disclosure obtains sectility of the fuse portion provided in the liquid ejection head substrate and suppresses spreading of an effect of degeneration of the covering portions when a heat generation element and a covering portions are in communication with each other.

According to the present disclosure, the sectility of the fuse portion provided in the liquid ejection head substrate can be obtained and the spreading of the degeneration effect of the covering portions can be suppressed when the heat generation element and the covering portions are in communication with each other.

Hereinafter, example embodiments of the present disclosure will be described with reference to the drawings. Note that the following description does not limit the scope of the present disclosure.

While an example embodiment is an ink jet printing apparatus (a printing apparatus) configured to circulate liquid, such as ink, between a tank and a liquid ejection apparatus, the example embodiment may have a different configuration. For example, the example embodiment may have a configuration in which the ink inside pressure chambers is made to flow without any circulation of the ink by providing two tanks on an upstream side and a downstream side of the liquid ejection apparatus and having the ink flow from one tank to the other.

While an example embodiment is a liquid ejection apparatus having a so-called line head that has a length corresponding to the width of the printed medium, the present disclosure can be applied to a so-called serial-type liquid ejection apparatus that performs printing while scanning the printed medium. The serial-type liquid ejection apparatus may have a configuration in which a single printing element substrate for black ink and a single printing element substrate for chromatic color ink are mounted, for example. Not limited to the above, a short line head that has a length shorter than the width of the printed medium and that includes a plurality of printing element substrates disposed in an ejection opening row direction so as to overlap the ejection openings may be fabricated, and the short line head may be configured to scan the printed medium.

Example Ink Jet Printing Apparatus

A schematic configuration of a liquid ejection apparatus of an example embodiment, in particular, an ink jet printing apparatus 1000 (hereinafter, also referred to as a printing apparatus) that performs printing by ejecting ink is illustrated in FIG. 1. The printing apparatus 1000 includes a conveying unit 101 that conveys a printed medium 102, and a line type liquid ejection head 103 disposed substantially orthogonal to a conveyance direction of the printed medium. The printing apparatus 1000 is a line type printing apparatus that performs continuous recording in one pass while conveying a plurality of printed mediums 102 continuously or intermittently. The printed medium 102 is not limited to a cut sheet and maybe a continuous roll sheet. The printing apparatus 1000 includes four liquid ejection heads 103 each for a single color corresponding to inks of four colors, namely, CMYK (cyan, magenta, yellow, and black). Furthermore, the printing apparatus 1000 includes caps 1007. Evaporation of the ink from the ejection openings can be prevented with the caps 1007 covering the ejection opening surface sides of the liquid ejection heads 103 during a non-recording period.

Example Printing Head

Figure 2A:
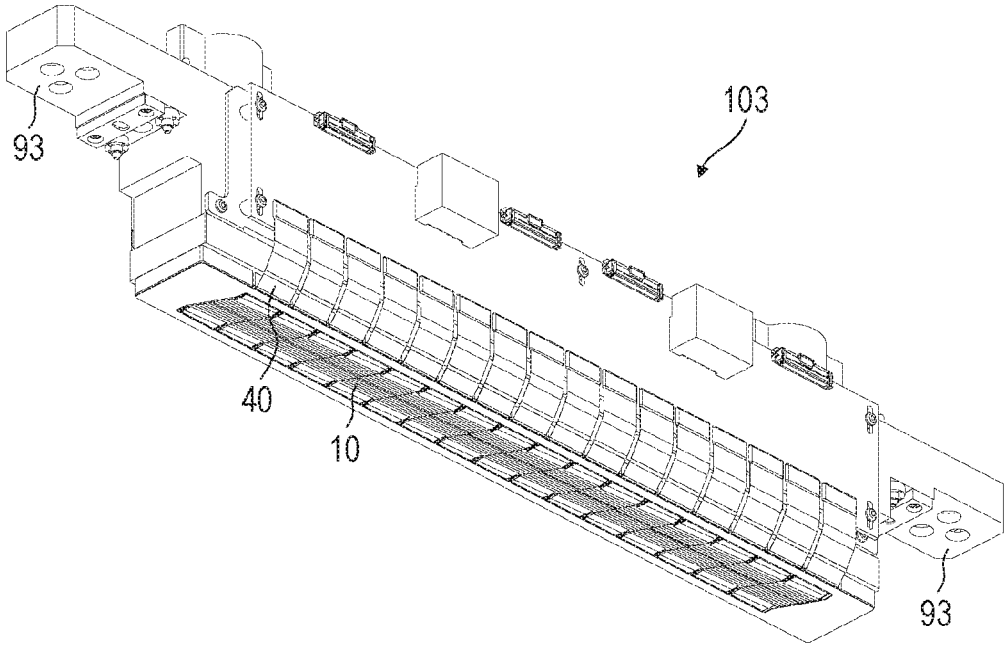
FIGS. 2A and 2B are perspective views of an example printing head.
Figure 2B:
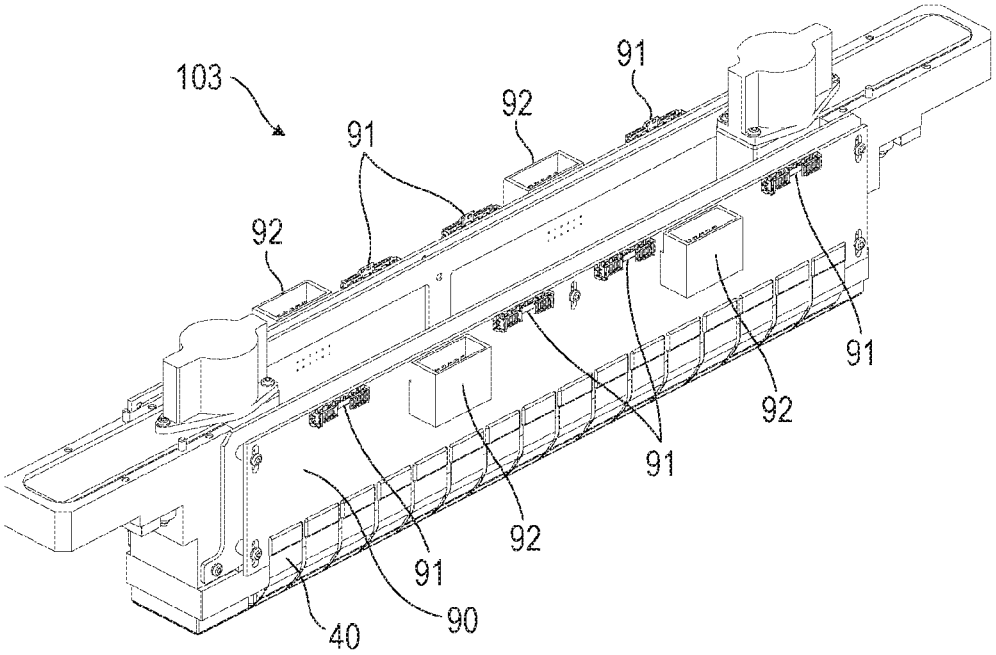

A configuration of a printing head 103 (the liquid ejection head 103) according to an example embodiment will be described. FIGS. 2A and 2B are perspective views of the liquid ejection head 103 according to the example embodiment. The liquid ejection head 103 is a line type liquid ejection head in which 16 printing element substrates 10, a single printing element substrate 10 being capable of ejecting ink of a single color, are aligned on a straight line (disposed inline). The liquid ejection heads 103 that eject each of the colors of ink are configured in a similar manner.

As illustrated in FIGS. 2A and 2B, the liquid ejection head 103 includes the printing element substrates 10, flexible wiring substrates 40, and electric wiring boards 90 provided with signal input terminals 91 and power supply terminals 92. The signal input terminals 91 and the power supply terminals 92 are electrically connected to a control unit of the printing apparatus 1000 and supply ejection drive signals and electric power necessary for the ejection to the printing element substrates 10. By integrating the wiring with the electric circuits in the electric wiring boards 90, the number of signal input terminals 91 and the number of electric power supply terminals 92 can be less than the number of printing element substrates 10. With the above, the number of electric connection portions needed to be dismounted can be small when the liquid ejection head 103 is installed in the printing apparatus 1000 or when the liquid ejection head is replaced. Connecting portions 93 provided on both end portions of the liquid ejection head 103 are connected to an ink supply system of the printing apparatus 1000. Ink is supplied to the liquid ejection head 103 through one of the connecting portions 93 from a supply system of the printing apparatus 1000, and the ink that has passed inside the liquid ejection head 103 is collected by the supply system of the printing apparatus 1000 through the other connecting portion 93. As described above, the liquid ejection head 103 is configured so that the ink can be circulated through the path of the printing apparatus 1000 and the path of the liquid ejection head 103.

Example Printing Element Substrate

Figure 3:
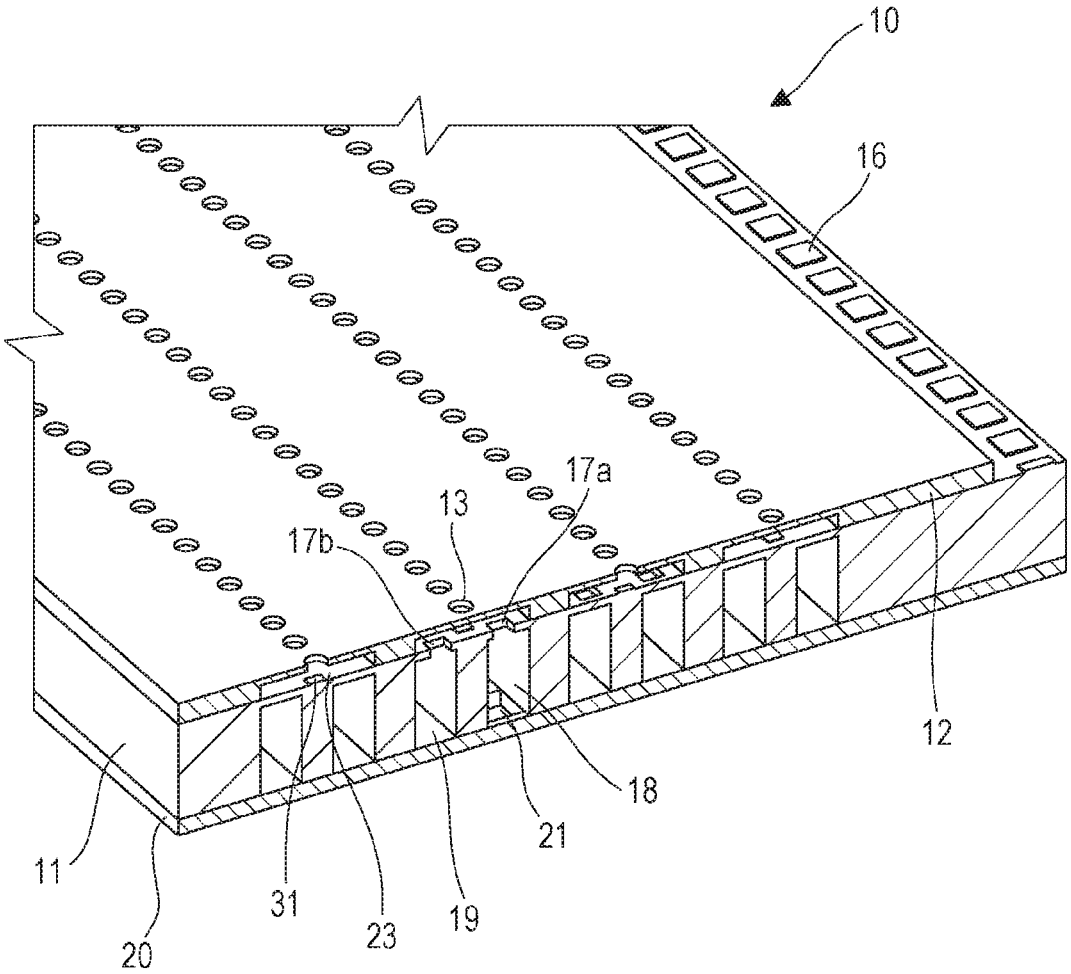
FIG. 3 is a perspective view schematically illustrating an example printing element substrate.

FIG. 3 is a perspective view schematically illustrating a printing element substrate 10 according to an example embodiment of the present disclosure. Note that in the present specification, a surface of the substrate or a layer on the side in which the liquid is ejected is referred to as a surface of the substrate or the layer, and a side of the substrate or a layer on which the liquid is ejected is referred to as an upper side of the substrate or the layer.

The printing element substrate 10 includes a substrate 11 (the liquid ejection head substrate) in which liquid supply passages 18 and liquid collection passages 19 are formed, a flow passage forming member 12 formed on a front surface side of the substrate 11, and a cover plate 20 formed on a back surface side of the substrate 11. Four lines of ejection opening rows each corresponding to a respective ink color are formed in the flow passage forming member 12 of the printing element substrate 10. In the substrate 11, a liquid supply passage 18 is provided on one side of each ejection opening row and a liquid collection passage 19 is provided on the other side of each ejection opening row. Each liquid supply passage 18 and each liquid collection passage 19 are provided so as to extend in the ejection opening row direction. Furthermore, a plurality of supply ports 17*a* in communication with the liquid supply passages 18 are provided in the substrate 11 in the ejection opening row direction, and a plurality of collection ports 17*b* in communication with the liquid collection passages 19 are provided in the substrate 11 in the ejection opening row direction as well.

As illustrated in FIG. 3, a heat applying portion 31 that forms a bubble in the liquid with thermal energy is disposed at a position corresponding to each ejection opening 13. The heat applying portions 31 are portions that add heat generated by the heat generation elements 15 (FIG. 5A) to the liquid. Note that the heat applying portions 31 are also used as first electrodes 31 described later.

Pressure chambers 23 (flow passages) including therein the heat applying portions 31 are sectioned with the flow passage forming member 12. The heat generation elements 15 corresponding to the heat applying portions 31 are electrically connected to terminals 16, which electrically couples the heat applying portions 31 to a portion external thereto, with electrical wiring provided in the substrate 11. Based on pulse signals from the electric wiring boards 90 input through the flexible wiring substrate 40 and the terminals 16, the heat generation elements 15 generate heat and boils the liquid inside the pressure chambers 23. With the bubbling force generated by boiling, the liquid is ejected through the ejection openings 13.

Furthermore, the cover plate 20 is provided with openings 21 that are in communication with the liquid supply passage 18 and openings 21 that are in communication with the liquid collection passages. The ink passing through the opening 21, the liquid supply passage 18, the supply port 17*a* in that order Is supplied to the pressure chamber 23. The ink supplied to the pressure chamber 23 is collected through the collection port 17*b*, the liquid collection passage 19, and the opening 21.

First Example Embodiment

Example Configuration of Liquid Ejection Head Substrate

Figure 4A:
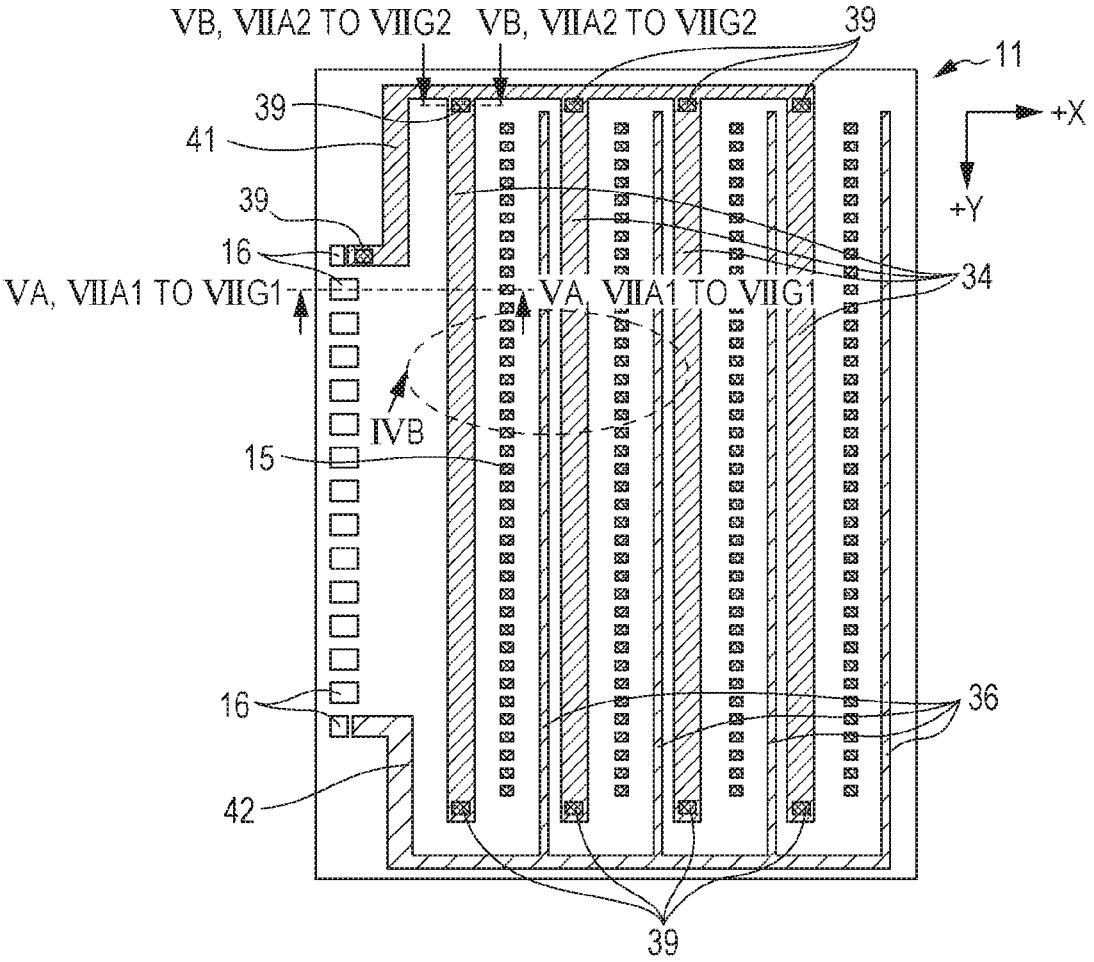
FIGS. 4A and 4B are schematic plan views of an example liquid ejection head substrate.

FIG. 4A is a schematic plan view of the substrate 11 according to the example embodiment of the present disclosure. Furthermore, FIG. 4B is a schematic plan view of an area IVB in FIG. 4A indicated by a broken line and is illustrated in an enlarged manner.

Figure 4B:
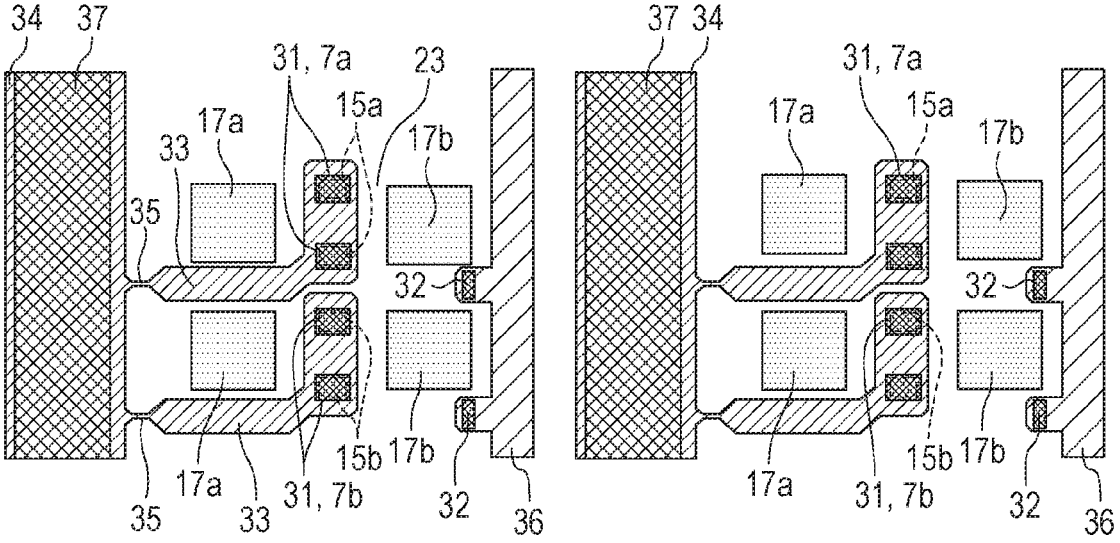

As illustrated in FIG. 4B, a protective layer 7 (covering portions) that protects the heat generation elements 15 from cavitation is provided so as to cover the heat generation elements 15. This protective layer 7 can be formed, for example, as a metal film including tantalum or iridium, or a layered film in which a plurality of the above metal films are layered. A surface of the protective layer 7 is provided so as to be in contact with the liquid inside the pressure chambers 23 and portions of the above protective layer 7 including the surface function as the first electrodes 31 positioned above the heat generation elements 15. Furthermore, second electrodes 32 corresponding to the first electrodes 31 are disposed inside the pressure chambers 23, and surfaces of the second electrodes 32 are provided so as to be in contact with the liquid inside the pressure chambers 23.

The present example embodiment is configured so that a voltage can be applied between the first electrodes 31 and the second electrodes 32 through the liquid. With the above, a voltage is applied between the first electrodes 31 and the second electrodes 32 through the liquid, and kogation adhered on the surface of the first electrodes 31 can be eluted into the liquid together with the first electrodes 31, and charged particles causing kogation can be repelled from the surfaces of the first electrodes 31. Hereinafter, from the viewpoint of removing kogation and suppressing adhesion of kogation, a description of the present example embodiment will be given with an example in which the portions of the first electrodes 31 and the second electrodes 32 including the surfaces in contact with the liquid are formed of iridium.

The first electrodes 31 and the second electrodes 32 are each connected to the corresponding terminal 16 (FIG. 4A) through wiring described later, and a voltage is applied between the first electrodes 31 and the second electrodes 32 from a portion external to the substrate 11 through the terminals 16.

As illustrated in FIG. 4B, the supply ports 17*a* and the collection ports 17*b* are disposed so as to interpose the heat generation elements 15 in between. Furthermore, a pair of supply ports 17*a* and a pair of collection ports 17*b* are disposed for two heat generation elements 15. A plurality of supply ports 17*a* are provided in the ejection opening row direction (a direction in which the heat generation elements 15 are arranged), and a plurality of collection ports 17*b* are also provided in the ejection opening row direction.

The first electrodes 31 are each connected to a piece of individual wiring 33 for the first electrode 31, which is provided so as to pass through a beam portion between adjacent supply ports 17*a*. Furthermore, the plurality of pieces of individual wiring 33 are electrically connected to a piece of common wiring 34 (a first wiring) for the first electrodes 31. The plurality of second electrodes 32 are electrically connected to a piece of wiring 36 for the second electrodes 32.

As illustrated in FIG. 4A, the pieces of common wiring 34 and the pieces of wiring 36 extend in the direction in which the ejection opening rows (the rows of heat generation elements 15) extend, and a single piece of common wiring 34 and a single piece of wiring 36 are provided for a single row of heat generation elements 15. The common wiring 34 is provided on a supply port 17*a* side with respect to the row of heat generation elements 15, and the wiring 36 is provided on a collection port 17*b* side with respect to the row of heat generation elements 15. The plurality of pieces of common wiring 34 and the plurality of pieces of wiring 36 are disposed on the substrate 11 so as to have a etenidium shape. The plurality of pieces of common wiring 34 are connected to the terminal 16 through a terminal connection wiring 41, and the plurality of pieces of wiring 36 are connected to the terminal 16 through a terminal connection wiring 42. Furthermore, the common wiring 34 and the wiring 36 are disposed between the rows of heat generation elements 15.

As illustrated in FIG. 4B, each common wiring 34 and the corresponding individual wiring 33 are connected with a fuse portion 35 provided in between. In other words, the common wiring 34 is electrically connected to a protective layer 7 (a first covering portion 7*a*) that covers a heat generation element 15 (a first heat generation element 15*a*) and a protective layer 7 (a second covering portion 7*b*) that covers another heat generation element 15 (a second heat generation element 15*b*). The fuse portions 35 are provided in the current paths between the common wiring 34 and the plurality of protective layers 7.

When a chance failure occurs and the heat generation element 15 and the protective layer 7 covering the heat generation element 15 become connected to each other, current flows from the heat generation element 15 to the fuse portion 35 through the protective layer 7, and the fuse portion 35 becomes disconnected. With the above, by electrically separating the protective layer 7 that has become connected to the heat generation element 15 from the common wiring 34, spreading of the degeneration of the above protective layer 7 to the protective layers 7 covering other heat generation elements 15 can be suppressed.

A width of each fuse portion 35 is narrower than a width of each individual wiring 33 so that when a current flows from a heat generation element 15 to a terminal 16, the relevant fuse portion 35 is melted. The width of the fuse portion 35 needs to be several micro meters or less in processing dimension, and is preferably 3 μm or less to secure sectility.

In the present example embodiment, a single fuse portion 35 is provided for a protective layer 7 that covers two heat generation elements 15. The manner in which the heat generation elements 15 and the fuse portions 35 are combined may be determined so that when a chance failure occurs in a heat generation element 15, the other heat generation elements 15 can compensate for the heat generation element 15 in which the chance failure has occurred.

However, as described above, there are pieces of common wiring 34 that are disposed between adjacent rows of heat generation elements 15. Accordingly, when the interval between adjacent rows of heat generation elements 15 is reduced to reduce the size of the substrate 11, since the width of the common wiring 34 disposed between the rows needs to be reduced as well, the wiring resistance of the common wiring 34 becomes higher. Furthermore, when the number of ejection openings 13 (the heat generation elements 15) is large and the ejection opening rows (the rows of heat generation elements) are long, the wiring resistance at the common wiring 34 becomes high in the fuse portion 35, among from the plurality of fuse portions 35, in which the distance from the terminal 16 to the fuse portion 35 via the common wiring 34 is long. As described above, when the wiring resistance of the common wiring 34 is high, the current flowing through the fuse portion 35 is small and the fuse portion 35 may not be cut.

Figure 5A:
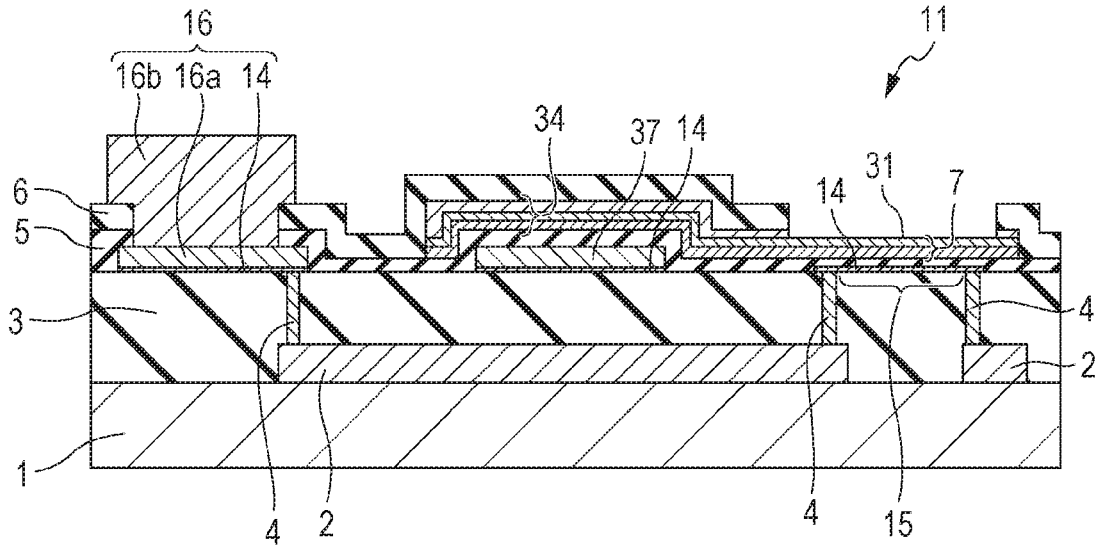
FIGS. 5A and 5B are cross-sectional views of a portion of the liquid ejection head substrate.
Figure 5B:
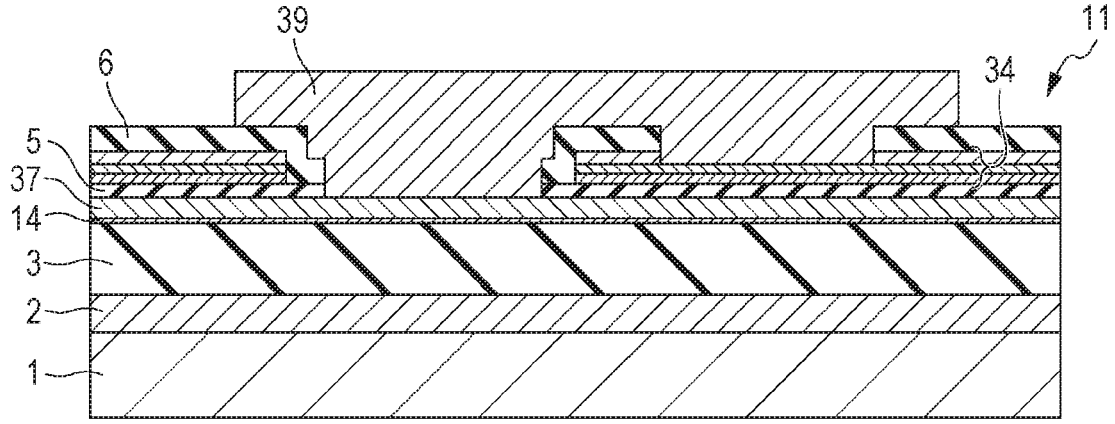

Accordingly, in the present example embodiment, wiring 37 (second wiring) is provided in a layer different from that of the common wiring 34 (first wiring) in a layered direction, or in a direction orthogonal to the surface of the substrate (FIG. 4B). Furthermore, the common wiring 34 and the wiring 37 are electrically connected to each other through a plurality of electric connection portions 39 provided so as to penetrate through an insulating layer 5. Furthermore, the plurality of electric connection portions 39 are provided between the terminal 16 and the fuse portions 35 and in the path of the current passing through the common wiring 34, and parallelly connect the common wiring 34 and the wiring 37 to each other. With the above, the wiring resistance in the path of the current between the terminal 16 and the fuse portions 35 is set low (FIG. 4A and FIG. 5B described later). With the above, a voltage drop in the common wiring 34 is suppressed and a decrease in the amount of current flowing through the fuse portions 35 is suppressed; accordingly, sectility of the fuse portions 35 can be obtained. In other words, when the heat generation element 15 and the protective layer 7 become connected to each other, the current flowing from the heat generation element 15 is allowed to flow through the wiring 37 such that the fuse portion 35 is cut easily. Accordingly, the influence exerted when the heat generation element 15 and the protective layer 7 become connected to each other can be suppressed from spreading to the protective layer 7 covering the other heat generation elements 15.

Note that as illustrated in FIG. 4A, in the present example embodiment, the electric connection portion 39 connecting the wiring 37 and the common wiring 34 to each other is provided at both end portions of each common wiring 34. Furthermore, an electric connection portion 39 that connects the terminal connection wiring 41, which connects the plurality of pieces of common wiring 34 and the terminal 16 to each other, and the pieces of wiring 37 to each other is provided in the vicinity of the terminal 16.

Note that in order to further reduce the wiring resistance in the path of the current between the terminal 16 and the fuse portions 35, desirably, a sheet resistance of the wiring 37 is set lower than a sheet resistance of the common wiring 34. For example, it is desirable to provide the wiring 37 using an alloy of aluminum and copper. For example, when an iridium layer is used for the protective layer 7, a film thickness of the iridium layer is preferably within the range of 30 to 100 nm in order to obtain sufficient durability, and in order to suppress the manufacturing load, a sheet resistance of the common wiring 34 formed to include the iridium layer constituting the protective layer 7 is about several ohms per square. On the other hand, when the wiring 37 is formed using an alloy of aluminum and copper, the sheet resistance is 1 Ω/sq or less with a thickness of 200 nm, for example. Accordingly, by electrically coupling the above two to each other, the effect of suppressing the wiring resistance in the path of the current between the terminal 16 and the fuse portions 35 can be obtained sufficiently.

Furthermore, in order to suppress an increase in the size of the substrate 11, desirably, the common wiring 34 and the wiring 37 are provided so as to overlap each other at least partially when the substrate 11 is viewed in plan view.

In the present example embodiment, as illustrated in FIG. 4A, for example, a length of the terminal connection wiring 41 that connects the common wiring 34, among the plurality of pieces of connection wiring 34, that is farthest from the terminal 16 and the terminal 16 to each other is 7 mm, and a width thereof is 70 μm. Furthermore, for example, a length of the common wiring 34 disposed between the rows of heat generation elements 15 is 20 mm, and a width thereof is 200 μm.

Subsequently, a layered configuration of the liquid ejection head substrate 11 will he described. FIG. 5A is a partial cross-sectional view of the substrate 11 taken along line VA-VA in FIG. 4A and is a diagram illustrating the heat generation element 15, the terminal 16, and the vicinity of the heat generation element 15 and the terminal 16. FIG. 5B is a partial cross-sectional view of the substrate 11 taken along line VB-VB in FIG. 4A and is a cross-sectional view illustrating the electric connection portion 39 that electrically couples the common wiring 34 and the wiring 37 to each other, and the vicinity of the electric connection portion 39.

A base 1 is configured by providing an insulating layer such as SiO (preferably several hundred nanometers thick) on a surface of a silicon substrate provided with a driving element and wiring for the driving element (both not shown). Furthermore, a wiring layer 2 formed of an alloy of aluminum and copper, for example, is provided on a front surface side of the insulating layer. Since the wiring layer 2 constitutes power wiring for driving the heat generation elements 15, a thickness thereof is preferably 200 to 2000 nm. Herein, the thickness of the wiring layer 2 is 1000 nm, for example.

An insulating layer 3 formed of, for example, SiO and with a thickness within the range of 1 to 2 μm. (1.5 μm in the present example embodiment, for example) is desirably provided on the surface of the wiring layer 2. A thermal resistor layer 14 formed of, for example, TaSiN or the like is provided on a surface of the insulating layer 3. In the thermal resistor layer 14, a portion supplied with electric power from the wiring layer 2 functions as the heat generation element 15. The size of the above heat generation element 15 is, for example, 15 μm by 15 μm. The heat generation element 15 and the wiring layer 2 are electrically connected to each other through plugs 4 that is formed of, for example, tungsten and that is provided in the insulating layer 3. Note that the base 1 on which the insulating layer 3 is provided, in other words, a member that is a combination of the base 1 and the insulating layer 3 may be referred to as a base. In such a case, the base includes a surface on which the heat generation element 15 is provided.

Furthermore, a metal layer is formed on the insulating layer 3 with the thermal resistor layer 14 in between. The wiring layer 37 and a terminal forming layer 16*a* constituting a portion of the terminal 16 for external connection are formed with the metal layer. An aluminum layer formed of an alloy of aluminum and copper, for example, can be used as the metal layer.

The insulating layer 5 (200 nm in thickness, for example) formed of SiN, SiC, SiCN or the like is provided so as to cover the heat generation element 15 and the wiring 37.

Furthermore, the protective layer 7 formed of a conductive material and for protecting the heat generation element 15 from cavitation is provided on a front surface side of the insulating layer 5 at a position corresponding to the heat generation element 15. In the present example embodiment, the protective layer 7 is a layered film in which a tantalum layer and an iridium layer are layered from the insulating layer 5 side. For example, regarding the thickness of the protective layer 7, the tantalum layer is 30 nm thick and the iridium layer is 70 nm thick.

Furthermore, the common wiring 34 is provided above the wiring 37 with the insulating layer 5 in between. In the present example embodiment, in order to suppress the manufacturing load, the common wiring 34 is configured to include at least some of the layers forming the protective layer 7. In the present example embodiment, the common wiring 34 has a three-layer structure in which a tantalum layer is provided above the iridium layer in addition to the tantalum layer and the iridium layer constituting the protective layer 7. For example, regarding the thickness of each layer of the common wiring 34 from the insulating layer 5 side, the tantalum layer is 30 nm, the iridium layer is 70 nm, and the tantalum layer is 70 nm. Note that the common wiring 34 may be formed using a material different from that of the protective layer 7 and in a different manufacturing process.

Note that as illustrated in FIG. 5A, desirably; the common wiring 34 is provided so as to cover step portions of the insulating layer 5 formed due to the end portions of the wiring 37. The reason for the above is that etching residues may be created at the step portions when etching is performed on the common wiring 34 so that the end portions of the common wiring 34 are formed inside the step portions of the insulating layer 5 formed by the end portions of the wiring 37.

Furthermore, an intermediate layer 6 including Si is disposed above the common wiring 34 and the insulating layer 5 in order to obtain adhesion with the flow passage forming member 12. For example, in the present example embodiment, in order to suppress corrosion caused by liquid, a SiCN film having high resistance to liquid and having a thickness of 150 nm is provided as the intermediate layer 6. Note that as illustrated in the cross-sectional view in FIG. 5A, in the area above the heat generation element 15, the tantalum layer and the intermediate layer 6 are removed so that a through hole is formed in the tantalum layer on the surface layer side and the intermediate layer 6 and so that the iridium layer is exposed. The first electrode 31 is formed with the above iridium layer. Similarly, the second electrode 32 (not shown in the cross-sectional view in FIG. 5A) is also formed by the iridium layer exposed with the removal of the tantalum layer on the surface layer side and the intermediate layer.

Furthermore, as illustrated in FIG. 5B, the common wiring 34 and the wiring 37 are connected to each other through the electric connection portion 39. The above electric connection portion 39 connects the surface of the iridium layer exposed by the removal of the tantalum layer on the surface layer side of the common wiring 34 and the intermediate layer 6, and the surface of the wiring 37 exposed by the removal of the insulating layer 5 and the intermediate layer 6. In other words, the electric connection portion 39 is provided so as to connect a surface of the common wiring 34 on a side opposite to the surface opposing the wiring 37, and the surface of the wiring 37 opposing the common wiring 34. Furthermore, the electric connection portion 39 is formed of a material that is the same as that of a terminal forming layer 16*b* constituting a portion of the terminal 16 illustrated in FIG. 5A. For example, the electric connection portion 39 and the terminal forming layer 16*b* are formed as layered films in which a layer formed of gold is provided on the front surface side and in which a TiW layer serving as a barrier metal is provided below the gold layer. Note that while FIG. 5A illustrates the terminal 16 electrically connected to the heat generation element 15, the terminal 16 connected to the common wiring 34 also has a similar layered configuration in which the terminal forming layer 16*a* and the terminal forming layer 16*b* are layered.

Figure 6A:
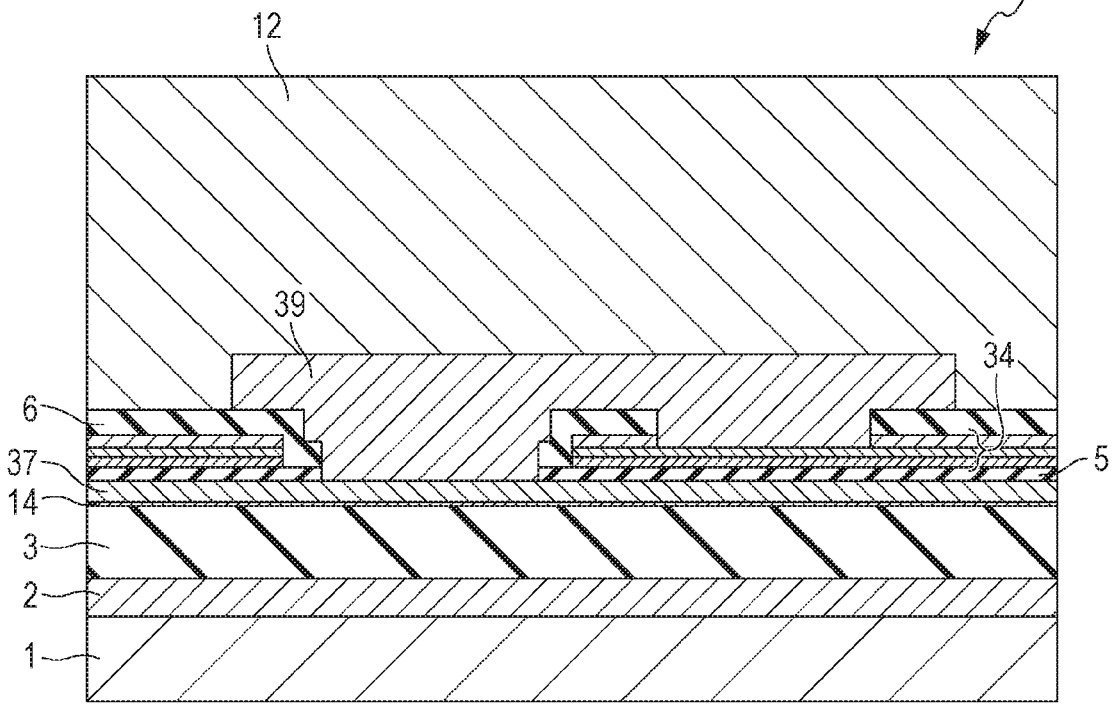
FIGS. 6A and 6B are cross-sectional views of a portion of the printing element substrate.
Figure 6B:
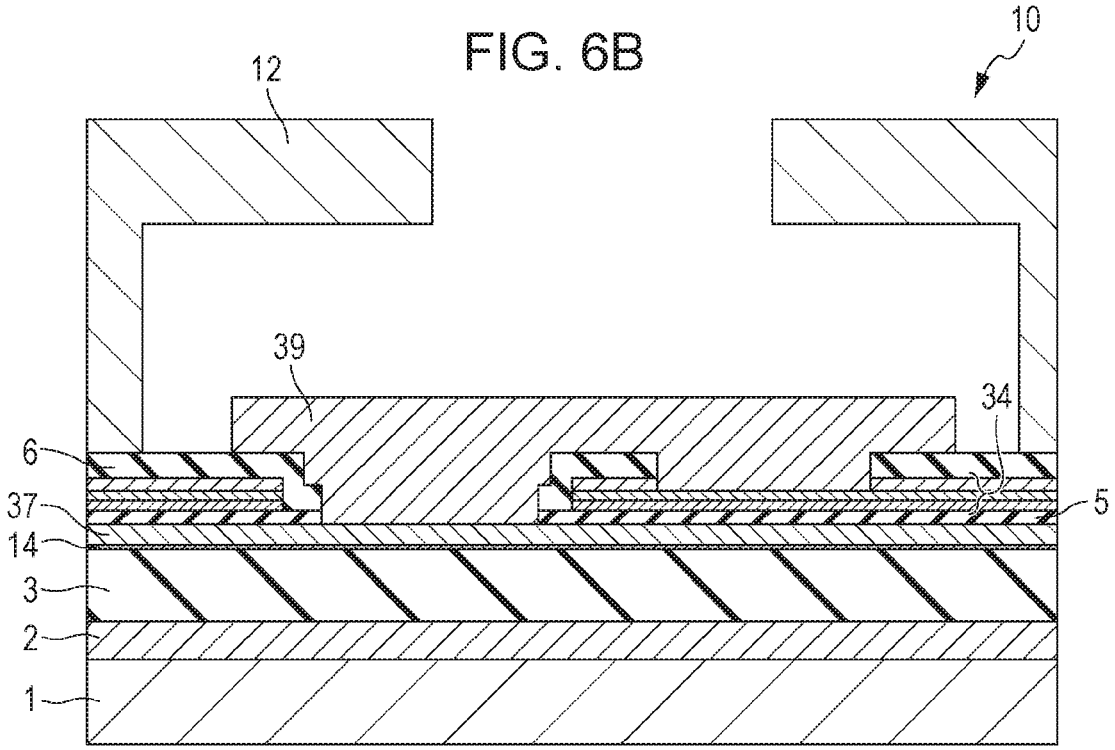

FIGS. 6A and 6B illustrate partial cross-sectional views of the printing element substrate 10 corresponding to the partial cross-sectional view of the liquid ejection head substrate 11 in FIG. 5B.

In the present example embodiment, since the electric connection portions 39 are provided on the upper layer side of the substrate 11, the liquid may contact the electric connection portions 39. Accordingly, in the example illustrated in FIG. 6A, the electric connection portion 39 is covered with the flow passage forming member 12 to protect the electric connection portion 39 from the liquid. Note that since it is only sufficient to protect the electric connection portion 39 from the liquid, the flow passage forming member 12 may be configured to cover the electric connection portion 39 so as to be in contact with the electric connection portion 39 or the flow passage forming member 12 may be configured so as to be disposed with a gap with the electric connection portion 39 and cover a portion around the electric connection portion 39.

In the example illustrated in FIG. 6B, the flow passage thrming member 12 provided around the electric connection portion 39 is provided with a gap with the electric connection portion 39 and, further, an opening is provided above the electric connection portion 39 and partially covers the electric connection portion 39. In order to prevent peeling between the flow passage forming member 12 and the electric connection portion 39 that includes gold, the flow passage forming member 12 and the electric connection portion 39 are configured so as not to be in direct contact with each other.

Note that if the number of electric connection portions 39 is large, the possibility of the liquid contacting the electric connection portions 39 increases. Accordingly, in the present example embodiment, a single electric connection portion 39 is provided above each of the two end portions of the common wiring 34 as described above (FIG. 4A). With the above, the wiring resistance of the common wiring 34 can be suppressed while suppressing the possibility of liquid intruding, and the sectility of the fuse portion 35 disposed at a position distanced from the terminal 16 can be obtained. Note that by having at least one of the electric connection portions 39 provided at both end portions of the common wiring 34 have a portion positioned outside the row of heat generation elements 15 in the row direction, the possibility of the liquid invading into the portion around the electric connection portion 39 can be suppressed further. Furthermore, between the electric connection portions 39 provided at both end portions of the common wiring 34, desirably, at least one of the electric connection portions 39 includes a portion positioned on the outer side in the row direction with respect to the row of the fuse portions 35 provided in the row direction of the heat generation elements 15. The above is desirable since with the above, the effect of suppressing the resistance of the common wiring 34 obtained by electrically connecting the common wiring 34 and the wiring 37 to each other can be improved.

Note that while the planar shape of the substrate 11 (the printing element substrate 10) illustrated in FIG. 4A is rectangular, the shape of the substrate 11 is not limited to the above shape. The planar shape of the substrate 11 may be, for example, a trapezoid or a parallelogram shape that has no right angles. With such a shape, it will be easier to configure the line type liquid ejection head illustrated in FIG. 2 having a plurality of printing element substrates 10 arranged on a straight line.

Example Method of Manufacturing Liquid Ejection Head Substrate

FIGS. 7A1 to 7G2 are cross-sectional views for illustrating manufacturing steps of the liquid ejection head substrate of the present example embodiment. FIGS. 7A1 to 7G1 illustrate partial cross-sectional views of the substrate 11 taken along lines VIIA1-VIIA1 to VIIG1I-VIIG1 in FIG. 4A, and FIGS. 7A2 to 7G2 illustrate partial cross-sectional views of the substrate 11 taken along lines VIIA2-VIIA2 to VIIG2-VIIG62 in FIG. 4A.

A base 1 provided with an insulating layer such as SiO on a surface of a silicon substrate provided with a driving element and wiring for the driving element (both not shown) is first prepared. Subsequently, a wiring layer 2 formed of an alloy of aluminum and copper, for example, is formed on a front surface side of the insulating layer of the base 1. Subsequently, an insulating layer 3 formed of, for example, SiO that covers the wiring layer 2 is formed, and a surface of the insulating layer 3 is planarized with a CMP method (FIGS. 7A1 and 7A2).

Subsequently, through holes are formed in the insulating layer 3, tungsten is formed by a CVD method to fill the through holes, for example, and, furthermore, the surface of the insulating layer 3 is planarized by a CMP method to form plugs 4, Further, a thermal resistor layer 14 formed of, for example, TaSiN and a metal layer formed of an alloy of aluminum and copper, for example, are formed with a sputtering method and pattering is performed. With the above, a terminal thrming layer 16*a* and wiring 37 are formed (FIGS. 7B1 and 7B2).

Subsequently, the metal layer on the thermal resistor layer 14 that is to become a heat generation element 15 is partially removed by wet etching to provide the heat generation element 15 (FIG. 7C1).

Subsequently, an insulating layer 5 formed of, for example, SiN is formed so as to cover the heat generation element 15 and the metal layer and, furthermore, a layered film of, for example, a tantalum layer/a iridium layer/a tantalum layer is formed with a sputtering method. The layered film is patterned to form common wiring 34 (FIG. 7D1), a fuse portion 35, wiring 36 for a second electrode 32, and the like. In so doing, in order to provide a connection area between the wiring 37 and an electric connection portion 39 formed in a later step, the common wiring 34 (a layered film) is patterned and a portion thereof is removed to form a through hole 34*a* in the common wiring 34 (FIG. 7D2).

Subsequently, an intermediate layer 6 formed of, for example, SiCN is formed so as to cover the layered film constituting the insulating layer 5 and the common wiring 34 (FIGS. 7E1 and 7E2).

Subsequently, first electrodes 31 and second electrodes 32 (FIG. 4B) are formed from the layered film. For the above, the intermediate layer 6 and the tantalum layer that is the outermost layer in the layered film, which are formed on the layered film above the portions that are to become the electrodes, are removed by dry etching, and through holes 8 that penetrate the above layers are formed (FIG. 7F1). With the above, the first electrode 31 positioned above the heat generation element 15 and the second electrode 32 corresponding to the first electrode 31 are formed. In other words, a protective layer 7 in which two layers, namely, the tantalum layer and the iridium layer, are layered on the heat generation element 15 is formed. Furthermore, in the same process as the above, the intermediate layer 6 and the tantalum layer that is the outermost layer in the layered film are removed to provide a connection area between the common wiring 34 and the electric connection portion 39 formed at a later step so that a through hole 9 that penetrates the above layers are formed (FIG. 7F2).

Subsequently, a through hole penetrating the insulating layer 5 and the intermediate layer 6 is provided to expose a surface of the terminal forming layer 16*a*, 1n the same process as the above, in order to expose a portion of a surface of the wiring 37, a through hole penetrating the insulating layer 5 and the intermediate layer 6 provided inside the through hole 34*a* (FIG. 7D2) of the common wiring 34 is formed. Furthermore, for example, as an underlayer, a TiW layer serving as a barrier metal is provided on the terminal forming layer 16*a*, and a terminal forming layer 16*b* provided with a gold layer is formed thereon (FIG. 7G1). With the above, the terminal 16 is formed. Furthermore, in the same process as above, for example, the TiW layer is provided in the underlayer and the electric connection portion 39 in which and the gold layer is provided thereon is formed. A portion of a surface of the exposed wiring 37 is connected to a surface of the iridium layer in the exposed common wiring 34 with the above electrical connection portion 39 (FIG. 7G2).

As described above, in the present example embodiment, the wiring 37 that is connected in parallel to the common wiring 34 between the terminal 16 and the fuse portions 35 is formed in the same step as the step in which the terminal 16 (the terminal forming layer 16*a*) is formed. Furthermore, the electric connection portion 39 that connects the common wiring 34 and the wiring 37 to each other is also formed in the same step as the step forming the terminal 16 (the terminal forming layer 16*b*). With the above, while suppressing the load in the manufacturing steps, the voltage drop in the common wiring 34 can be suppressed and the sectility of the fuse portion 35 can be obtained.

Second Example Embodiment

A liquid ejection head substrate of the present example embodiment will be described mainly on points different from the example embodiment described above.

Figure 8A:
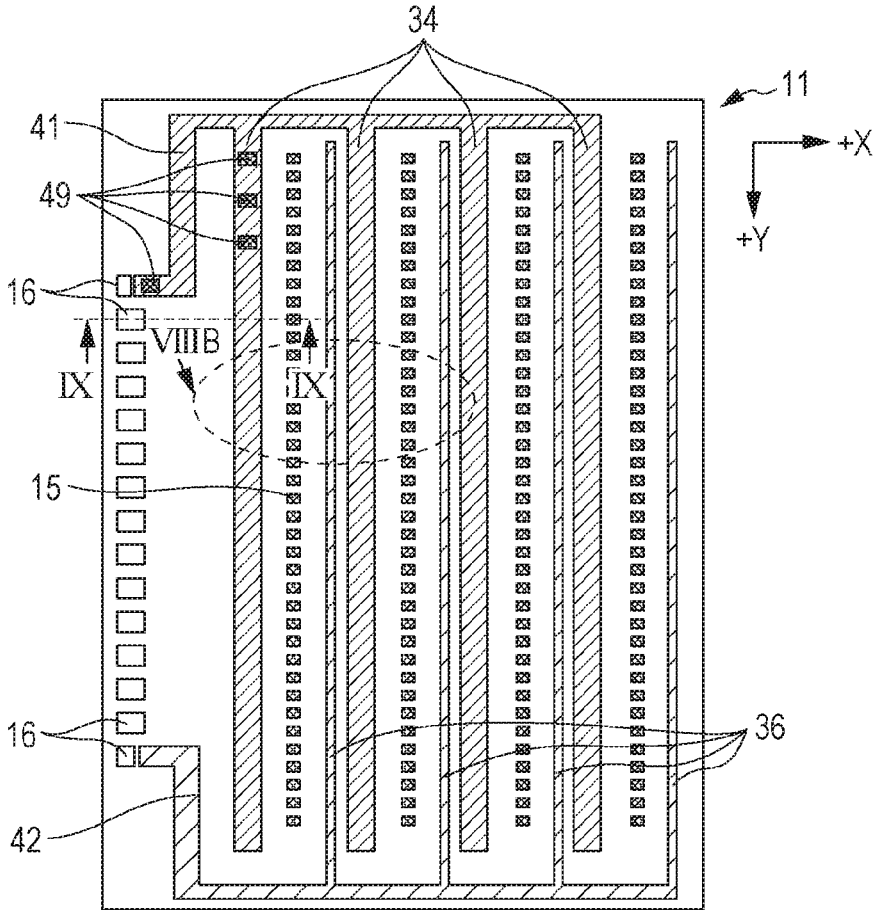
FIGS. 8A and 8B are schematic plan views of the liquid ejection head substrate.
Figure 8B:
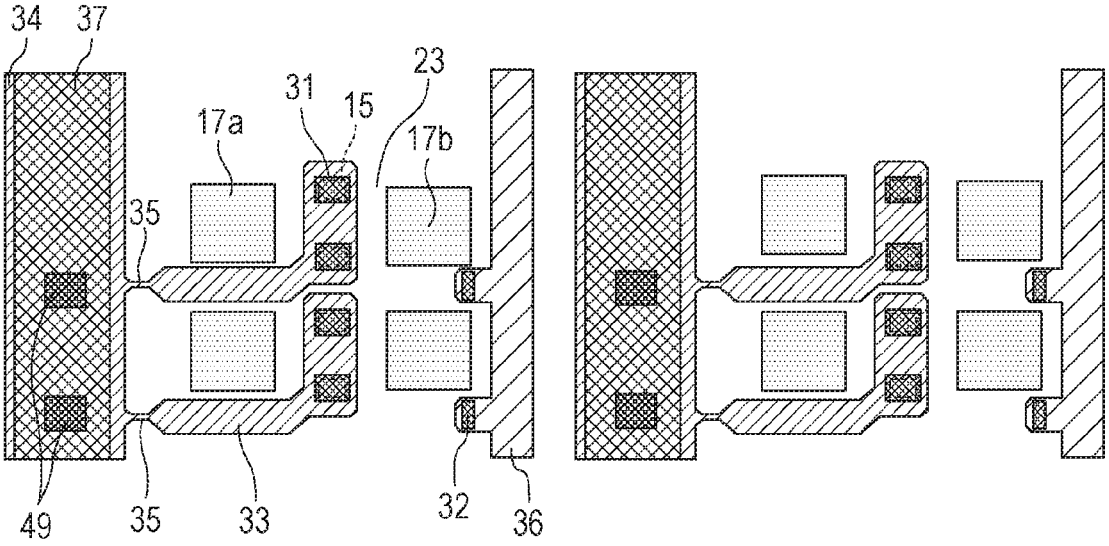

FIG. 8A is a schematic plan view of the substrate 11 according to the example embodiment of the present disclosure. Furthermore, FIG. 8B is a schematic plan view of an area VIIIB indicated by a broken line in FIG. 8A and is illustrated in an enlarged manner.

Figure 9:
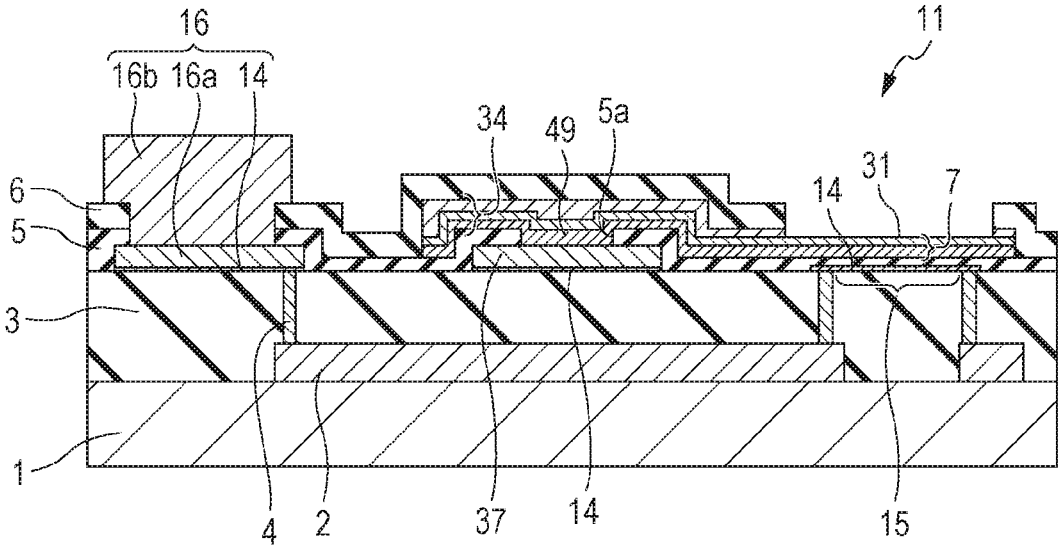
FIG. 9 is a cross-sectional view of a portion of the liquid ejection head substrate.

FIG. 9 is a partial cross-sectional view of the substrate 11 taken along line IX-IX in FIG. 8A, and is a diagram illustrating the electric generating element 15, the terminal 16, electric connection portions 49 that electrically connect the common wiring 34 and the wiring 37 to each other, and the vicinity of the above.

In the present example embodiment, the configuration of the electric connection portion 49 is different from that of the example embodiment described above, and as illustrated in FIG. 9, a through hole 5*a* is provided in the insulating layer 5 between the common wiring 34 and the wiring 37, and the electric connection portion 49 is formed by directly connecting the common wiring 34 and the wiring 37 to each other.

In the present example embodiment, the intermediate layer 6 having a high bondability with the flow passage thrming member 12 is provided on the front surface side of the substrate 11, and the electric connection portion 39 such as the one in the example embodiment described above is not exposed towards the front surface side of the substrate 11; accordingly, adhesion between the flow passage forming member 12 and the substrate 11 can be obtained. Accordingly, as illustrated in FIG. 8B, a single electric connection portion 49 corresponding to a single fuse portion 35 can also be provided. With the above, while further suppressing the voltage drop in the common wiring 34, the sectility of the fuse portion 35 can be improved further.

In the present example embodiment, a through hole 5*a* is formed in the insulating layer 5 after forming the insulating layer 5. In a state in which the through hole 5*a* is provided, a portion of a surface of the wiring 37 is exposed from an opening of the through hole 5*a* and an insulating film may be formed on the surface. In order to sufficiently establish an electrical connection between the common wiring 34 and the wiring 37, after forming the through hole 5*a* and before the layer constituting the common wiring 34 is formed, desirably, reverse sputtering is performed and the insulating film on the surface is removed. Note that the insulating layer 5 on the heat generation element 15 may be scraped off as well with the reverse sputtering step. Accordingly, in order to obtain the insulation properties between the heat generation element 15 and the protective layer 7, the configuration of the present example embodiment can be said to be effective when the insulating layer 5 is thick.

Figure 10:
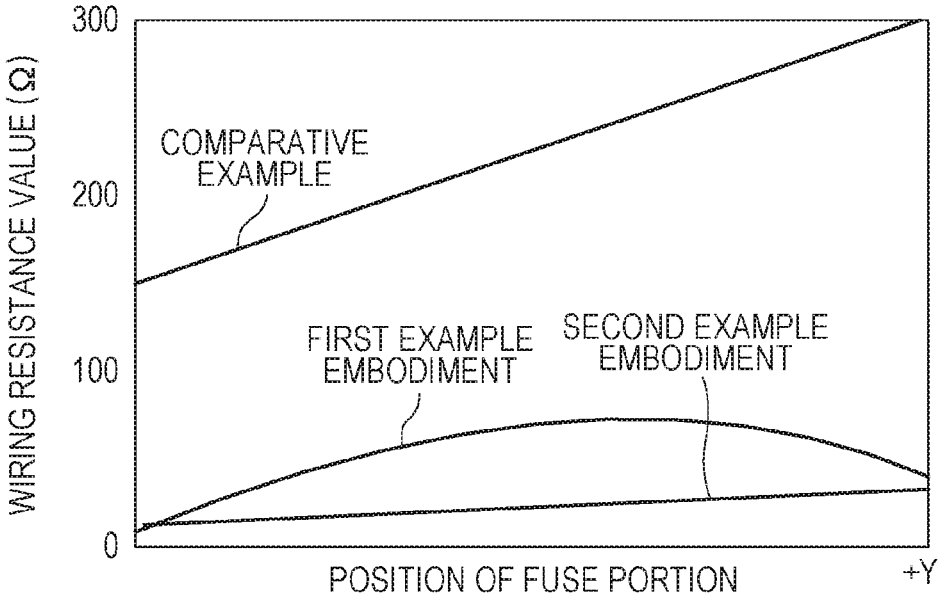
FIG. 10 is a graph illustrating wiring resistance values between a terminal fuse portions.

Wiring Resistance to Fuse Portion in Example Embodiments and in Comparative Example FIG. 10 is a graph illustrating wiring resistance values between the terminal 16 and the fuse portions 35 in the example embodiments described above and in the comparative example. Note that unlike the example embodiments described above, the comparative example is not provided with the wiring 37, and the portion between the terminal 16 and the fuse portions 35 is connected with the common wiring 34 and the terminal connection wiring 41. FIG. 10 illustrates the wiring resistance values from the terminal 16 to each of the fuse portions 35 in the row of heat generation element 15 disposed at a position that is farthest from the terminal 16 in the +X direction (FIGS. 4A and 8A). Furthermore, the axis of abscissas in FIG. 10 indicates the position of each fused portion 35 in the +Y direction (FIGS. 4A and 8A), and the distance from the terminal 16 to the fuse portion 35 passing through the common wiring 34 increases towards the right side of the graph.

Note that the sheet resistance of the common wiring 34 is 1.6 Ω/sq, and compared to the sheet resistance of the common wiring 34, the sheet resistance of the wiring 37 is significantly low at 0.1 Ω/sq.

The first and second example embodiments are provided with electric connection portions 39 and electric connection portions 49 (FIGS. 4A and 8A) that connect the pieces of wiring 37 to the vicinity of the terminal 16. Accordingly, the wiring resistance value from the terminal 16 is, compared with that of the comparative example, low in either of the fuse portions 35. Furthermore, in the first example embodiment, since the electric connection portions 39 that connect the wiring 37 and the common wiring 34 to each other are provided at the two end portions of the common wiring 34, the resistance values from the terminal 16 to the fuse portions 35 positioned in the vicinities of the electric connection portions 39 are low. In the second example embodiment, since the electric connection portions 49 are provided so as to correspond to the fused portions 35, the wiring resistance from the terminal 16 to the fuse portions 35 is even lower than that in the first example embodiment. As described above, since the present example embodiments are capable of suppressing the wiring resistance to the fuse portions 35, the sectility of the fuse portions 35 can be obtained.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2018-087531 filed Apr. 27, 2018, and No. 2019-042261 filed Mar. 8, 2019, which are hereby incorporated by reference herein in their entirety.

What is claimed is:

1. A liquid ejection head substrate comprising:

a base including a surface in which a first heat generation element and a second heat generation element that generate heat to eject liquid are provided;

a conductive first covering portion that covers the first heat generation element, a conductive second covering portion that covers the second heat generation element;

an insulating layer disposed between the first heat generation element and the first covering portion, and between the second heat generation element and the second covering portion;

a fuse portion;

first wiring electrically connected to the first covering portion through the fuse portion, the first wiring electrically connecting the first covering portion and the second covering portion to each other;

a terminal electrically connected to the first covering portion and the second covering portion through the first wiring;

second wiring provided at a position different from that of the first wiring in an orthogonal direction with respect to the surface of the base; and a plurality of electric connection portions provided between the fuse portion and the terminal in a path of current passing through the first wiring, the plurality of electric connection portions connecting the first wiring and the second wiring to each other in parallel.

2. The liquid ejection head substrate according to claim 1, further comprising:

an element row in which a plurality of heat generation elements including the first heat generation element and the second heat generation element are arranged, p1 wherein the first wiring and the second wiring extend in an element row direction.

3. The liquid ejection head substrate according to claim 2, wherein the electric connection portions are provided at both end portions of the first wiring in the element row direction.

4. The liquid ejection head substrate according to claim 2, further comprising:

a plurality of covering portions that include the first covering portion and the second covering portion and that cover the plurality of heat generation elements; and a row of fuse portions in which fuse portions that connect the plurality of covering portions and the first wiring to each other are provided in the element row direction, wherein at least one of the plurality of electric connection portions includes a portion positioned on an outer side of the row of fuse portions in a row direction.

5. The liquid ejection head substrate according to claim 1, wherein the second covering portion is electrically connected to the first wiring through another fuse portion other than the fuse portion, and wherein the electric connection portions are provided so as to correspond to the fuse portion and the another fuse portion other than the fuse portion.

6. The liquid ejection head substrate according to claim 1, wherein a sheet resistance of the second wiring is lower than a sheet resistance of the first wiring.

7. The liquid ejection head substrate according to claim 1, wherein the insulating layer is disposed between the first wiring and the second wiring in the orthogonal direction, and wherein at least a portion of each of the plurality of electric connection portions is provided so as to penetrate the insulating layer.

8. The liquid ejection head substrate according to claim 1, wherein when viewed in the orthogonal direction, the first wiring and the second wiring overlap each other at least partially.

9. The liquid ejection head substrate according to claim 8, wherein in the orthogonal direction, the second wiring, the insulating layer, and the first wiring are disposed in that order from a base side, and wherein the first wiring covers a step portion of the insulating layer that covers an end portion of the second wiring.

10. The liquid ejection head substrate according to claim 1, wherein the second wiring is constituted by a material that is the same as that of at least one terminal forming layer constituting the terminal, and is configured as the same layer as the at least one terminal forming member in the orthogonal direction.

11. The liquid ejection head substrate according to claim 1, wherein the plurality of electric connection portions are provided as layers that are different from the first wiring and the second wiring.

12. The liquid ejection head substrate according to claim 11, wherein the first wiring is positioned farther from the base than the second wiring in the orthogonal direction, and wherein the plurality of electric connection portions connect a surface of the first wiring on an opposite side with respect to a surface thereof opposing the second wiring, and a surface of the second wiring opposing the second wiring to each other.

13. The liquid ejection head substrate according to claim 11, wherein the plurality of electric connection portions are constituted by a material that is the same as that of at least one terminal forming layer constituting the terminal, and are configured as the same layer as the at least one terminal forming member in the orthogonal direction.

14. The liquid ejection head substrate according to claim 1, wherein the insulating layer is disposed between the first wiring and the second wiring in the orthogonal direction, and wherein the plurality of electric connection portions are constituted by having the first wiring and the second wiring be in contact with each other through a plurality of through holes provided in the insulating layer.

15. A method of manufacturing a liquid ejection head substrate including a base including a first heat generation element and a second heat generation element that generate heat to eject liquid, a conductive first covering portion that covers the first heat generation element, a conductive second covering portion that covers the second heat generation element, an insulating layer disposed between the first heat generation element and the first covering portion, and between the second heat generation element and the second covering portion, a fuse portion, first wiring electrically connected to the first covering portion through the fuse portion, the first wiring electrically connecting the first covering portion and the second covering portion to each other, and a terminal electrically connected to the first covering portion and the second covering portion through the first wiring, the method of manufacturing a liquid ejection head substrate comprising;

preparing the base provided with a second wiring on a surface thereof;

forming the insulating layer so as to cover the second wiring;

forming the first wiring on the insulating layer; and forming the plurality of electric connection portions in which at least a portion of each of the plurality of electric connection portions penetrate the insulating layer, in which the plurality of electric connection portions are provided between the fuse portion in the path of the current passing through the first wiring and the terminal, and in which the plurality of electric connection portions connect the first wiring and the second wiring to each other in parallel.

16. The method of manufacturing a liquid ejection head substrate according to claim 15, wherein in the preparing of the base, a metal layer formed on the surface of the base is patterned and the second wiring and at least one terminal forming layer that constitutes the terminal are formed from the metal layer.

17. The method of manufacturing a liquid ejection head substrate according to claim 15, wherein in forming the plurality of electric connection portions, at least a portion of the terminal forming layer constituting the terminal is formed together in the forming.

18. A liquid ejection head comprising:

a liquid ejection head substrate including a base including a surface in which a first heat generation element and a second heat generation element that generate heat to eject liquid are provided, a conductive first covering portion that covers the first heat generation element, a conductive second covering portion that covers the second heat generation element, an insulating layer disposed between the first heat generation element and the first covering portion, and between the second heat generation element and the second covering portion, a fuse portion, first wiring electrically connected to the first covering portion through the fuse portion, the first wiring electrically connecting the first covering portion and the second covering portion to each other, and a terminal electrically connected to the first covering portion and the second covering portion through the first wiring; and a flow passage forming member provided on a first covering portion side of the liquid ejection head substrate, the flow passage forming member forming, together with the liquid ejection head substrate, a flow passage through which the liquid is made to flow, wherein the liquid ejection head substrate includes second wiring provided at a layer different from that of the first wiring in an orthogonal direction with respect to the surface of the base, and a plurality of electric connection portions provided between the fuse portion and the terminal in a path of current passing through the first wiring, the plurality of electric connection portions connecting the first wiring and the second wiring to each other in parallel.

19. The liquid ejection head according to claim 18, wherein the plurality of electric connection portions are provided on a surface of the liquid ejection head substrate on a flow passage thrming member side, and wherein the flow passage forming member convers at least a portion of the plurality of electric connection portions.

20. The liquid ejection head according to claim 19, wherein the flow passage forming member is in contact with the plurality of electric connection portions.

21. The liquid ejection head according to claim 19, wherein the flow passage forming member is provided so as to form a gap with the plurality of electric connection portions.

* * * * *